United States Patent [19]

Shoemaker, Jr.

[11] Patent Number: 4,778,176

[45] Date of Patent: Oct. 18, 1988

[54] AMUSEMENT APPARATUS

[76] Inventor: Stephen P. Shoemaker, Jr., 123 International Boardwalk, Redondo Beach, Calif. 90277

[21] Appl. No.: 946,852

[22] Filed: Dec. 29, 1986

[51] Int. Cl.[4] ..... A63F 9/00

[52] U.S. Cl. ..... 273/1 GC; 212/225; 221/209

[58] Field of Search ..... 273/1 GC, 199; 221/209, 221/210; 212/225-228, 97-116

[56] References Cited

U.S. PATENT DOCUMENTS

| | | | |
|---|---|---|---|
| 1,417,663 | 5/1922 | French | 212/225 X |
| 1,539,546 | 5/1925 | Deenik | 212/228 |
| 1,878,894 | 9/1932 | Sallee | 221/210 |
| 1,927,877 | 9/1933 | Meyer | 221/210 |
| 1,938,834 | 12/1933 | Graf | 221/210 |
| 2,005,692 | 6/1935 | Margolith | 221/209 |
| 2,057,880 | 10/1936 | Collison et al. | 221/209 |
| 2,143,111 | 1/1939 | Hayes | 212/225 X |
| 2,302,821 | 11/1942 | Walton | 221/209 |
| 2,600,849 | 6/1952 | Collins et al. | 221/210 X |
| 2,743,024 | 4/1956 | Schmitt et al. | 212/214 |
| 3,572,703 | 3/1971 | Greene | 273/1 GC |
| 3,764,900 | 10/1974 | Baldwin | 33/1 M X |
| 4,133,525 | 1/1979 | Balles et al. | 273/1 E |
| 4,246,452 | 1/1981 | Chandler | 273/148 BX |
| 4,272,649 | 6/1981 | Pfeiffer | 273/1 EX |
| 4,369,579 | 1/1983 | Mizoule | 33/1 M |
| 4,408,103 | 10/1983 | Smith, III | 273/148 BX |
| 4,550,503 | 11/1985 | Klawitter | 33/1 MX |
| 4,600,083 | 7/1986 | Parent et al. | 33/1 MX |
| 4,685,673 | 8/1987 | Verstraeten | 273/1 GG X |

FOREIGN PATENT DOCUMENTS

| | | | |
|---|---|---|---|
| 789575 | 10/1935 | France | 221/209 |
| 685361 | 3/1965 | Italy | 273/199 |
| 455355 | 10/1936 | United Kingdom | 273/1 GG |
| 574507 | 1/1946 | United Kingdom | 221/209 |

OTHER PUBLICATIONS

Popular Science, 6-1984, p. 14 (273/148B).

*Primary Examiner*—Paul E. Shapiro

*Attorney, Agent, or Firm*—Brown, Martin, Haller & Meador

[57] ABSTRACT

An amusement apparatus in which a player controls positioning of a pick-up device such as a mechanical grabber having moveable claws or pincers over a floor area on which prize objects are placed. The floor area is rotatable and the pick up device is attached to an overhead transport mechanism for moving it back and forth across a portion of the floor area, so that the pick up device can cover the entire prize area during one complete revolution of the floor. Several pick up devices may be provided at spaced positions around the floor area so that more than one player may use the device at the same time. The floor area is preferably circular, and rotates around its center axis with the pick up devices travelling back and forth between the center and outer edge of the floor area. The entire device is enclosed in an outer housing which is at least partially transparent.

17 Claims, 4 Drawing Sheets

AMUSEMENT APPARATUS

BACKGROUND OF THE INVENTION

The present invention relates to an amusement apparatus of the crane or claw game type in which a player manipulates a mechanical claw or crane like apparatus in attempting to retrieve prizes on a floor beneath the claw.

In my copending U.S. patent application Ser. No. 791,687, entitled "Amusement Device", which was filed on Oct. 28th, 1985, an amusement device of this type is described in which a claw is transported in a horizontal plane over a prize floor by means of X and Y direction transport mechanisms. A vertical transport mechanism controls lowering of the claw or pick up device to the prize floor. This device can only be operated by one player at a time.

SUMMARY OF THE INVENTION

It is an object of the present invention to provide an amusement apparatus of the claw type in which the transport mechanism is simplified.

According to the present invention an amusement apparatus is provided which comprises a housing, a rotatable floor in the housing over which prize items can be distributed, a drive assembly for rotating the floor, and at least one pick-up device within the housing for attempting to pick up items from the floor. An overhead horizontal transport mechanism is linked to the pick-up device for transporting it back and forth in two opposite directions above the rotatable floor, and a vertical transport mechanism controls movement of the pick up device up and down between a raised position and a lowered position at the level of the prizes. The housing includes at least one delivery chute for delivering any picked up items to a player, and the transport mechanism preferably returns to a predetermined start position at the end of each game sequence.

A control mechanism for controlling operation of the apparatus includes an external control assembly for operation by the player to control movement of the pick up device back and forth above the floor. The control assembly preferably also allows at least some degree of control by the player over the vertical movement of the pick-up device, and the actuation of the pick-up device to attempt to pick up a prize. Movement of the pick up device back to a start position over the delivery chute may be either automatic or player controlled.

This apparatus is considerably simplified over similar games where the horizontal transport mechanism has to allow movement in at least two perpendicular directions over a playing floor in order to cover the entire floor area. In this apparatus the pick up device simply has to be transported back and forth in two opposite directions between two extreme positions. In the preferred arrangement one of the extreme positions will comprise a home position above a delivery chute just outside the floor area. The other extreme position may be above the opposite side edge of the playing floor, or alternatively above the central area of the playing floor. The latter arrangement will allow more than one pick up device to be provided, so that the apparatus can be operated by more than one player simultaneously.

In each case the entire floor area will rotate under the line of horizontal travel of the pick up device once for each full rotation of the floor area, so that the player can aim for a desired prize anywhere on the playing floor by suitably positioning the claw device along its horizontal line of travel, and lower the pick up device to meet the prize as it rotates into a position directly beneath the pick up device. The control assembly preferably includes a control for stopping the pick up device during its descent, so that if the player has misjudged the timing for the pick up device to meet the prize, the descent can be stopped momentarily and then re-started. Preferably, an operator controlled pick up device actuator is provided in the control assembly, so that the operator can actuate the pick up device to attempt to pick up the prize as soon as an appropriate position of the pick up device and prize is reached. At this point, the pick up device is preferably automatically returned to a home position and opened to release any picked up prize, at which point the game sequence will be at an end.

In a preferred embodiment of the invention the prize floor is circular and rotates about its central axis. A series of spaced pick up devices is provided about the prize floor, each pick up device being associated with a respective transport mechanism and external player control assembly, so that several players may use the apparatus simultaneously. Thus, rather than having to provide several individual machines, a single machine can accommodate several players.

In this arrangement each of the pick up devices is associated with a respective delivery chute outside the edge of the prize floor, and moves horizontally back and forth between a first, home position above the delivery chute and a second position above a location adjacent the center axis of the floor. Preferably, the prize floor rotates continuously as players attempt to pick up prizes.

Thus the amusement apparatus of this invention has a simplified transport mechanism which is easier to operate, and allows more than one pick up device to be provided in a single apparatus, so that several players can use the apparatus simultaneously.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT

Figure 1:
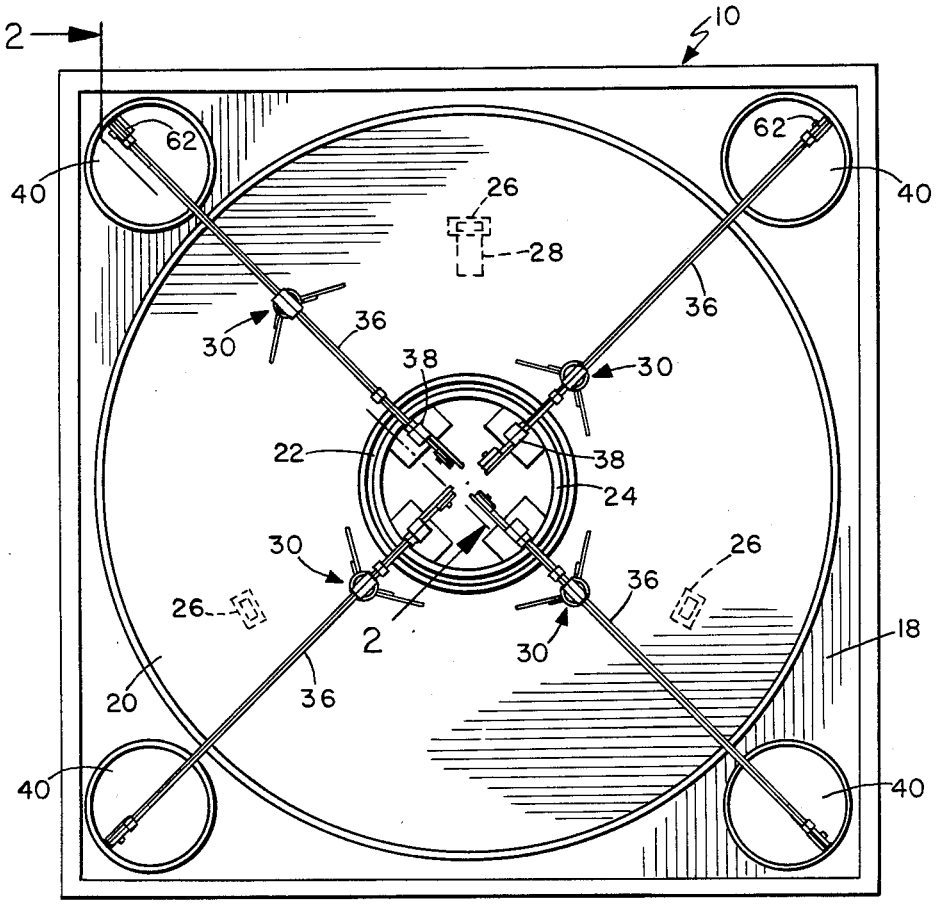
FIG. 1 is a top plan view of a four unit game apparatus, with the top cover removed and with the claw drive motors omitted for clarity.

A claw or crane amusement apparatus or game machine 10 according to a preferred embodiment of the invention is shown in the drawings. The apparatus 10 comprises an outer housing 12, which in the embodiment shown is of rectangular cross-section but which may alternatively be circular or of other shapes, with a crane-like game apparatus mounted in the housing. The side walls 14 of the housing are suitably transparent windows to allow players to view the interior of the housing.

Figure 2:
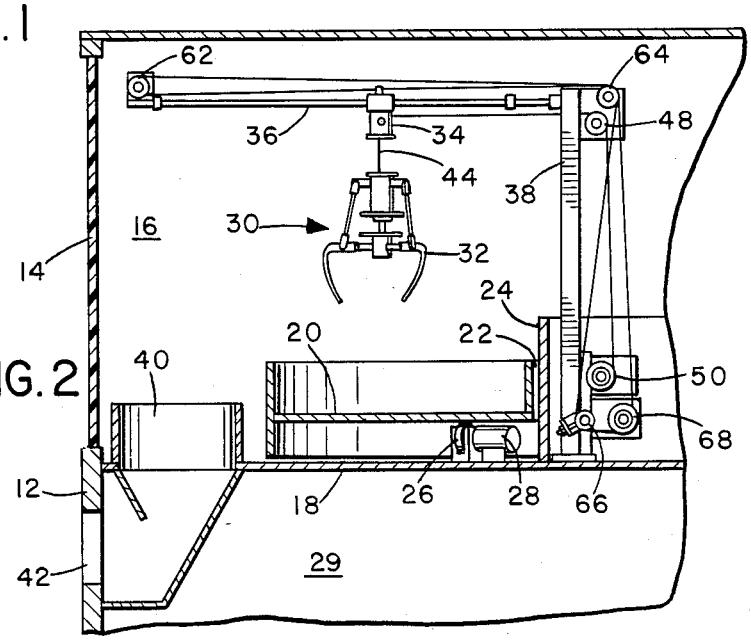
FIG. 2 is a sectional view taken on line 2—2 of FIG. 1.
Figure 7:
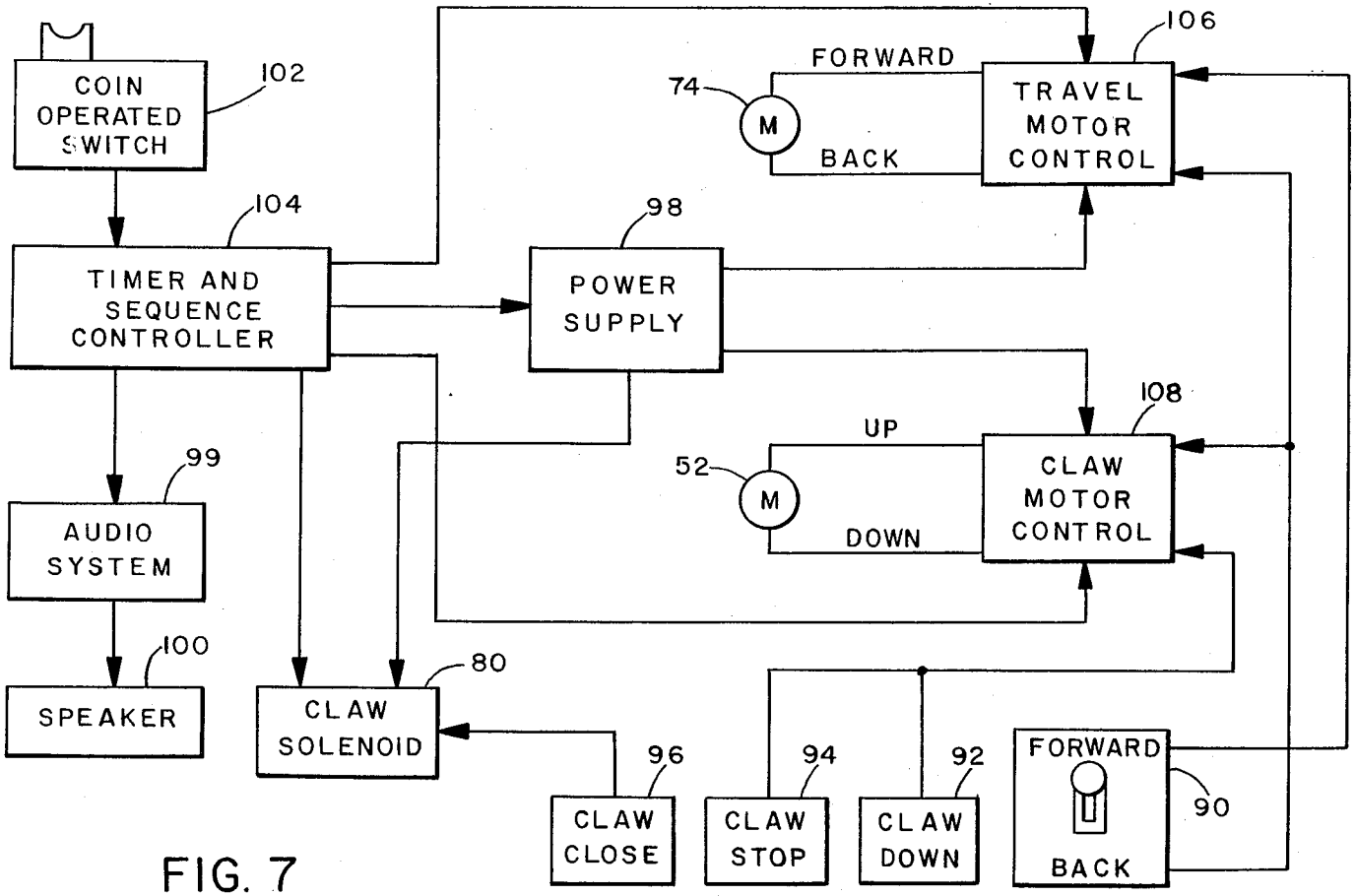
FIG. 7 is a block diagram of a control circuit for operating the game.
Figure 8:
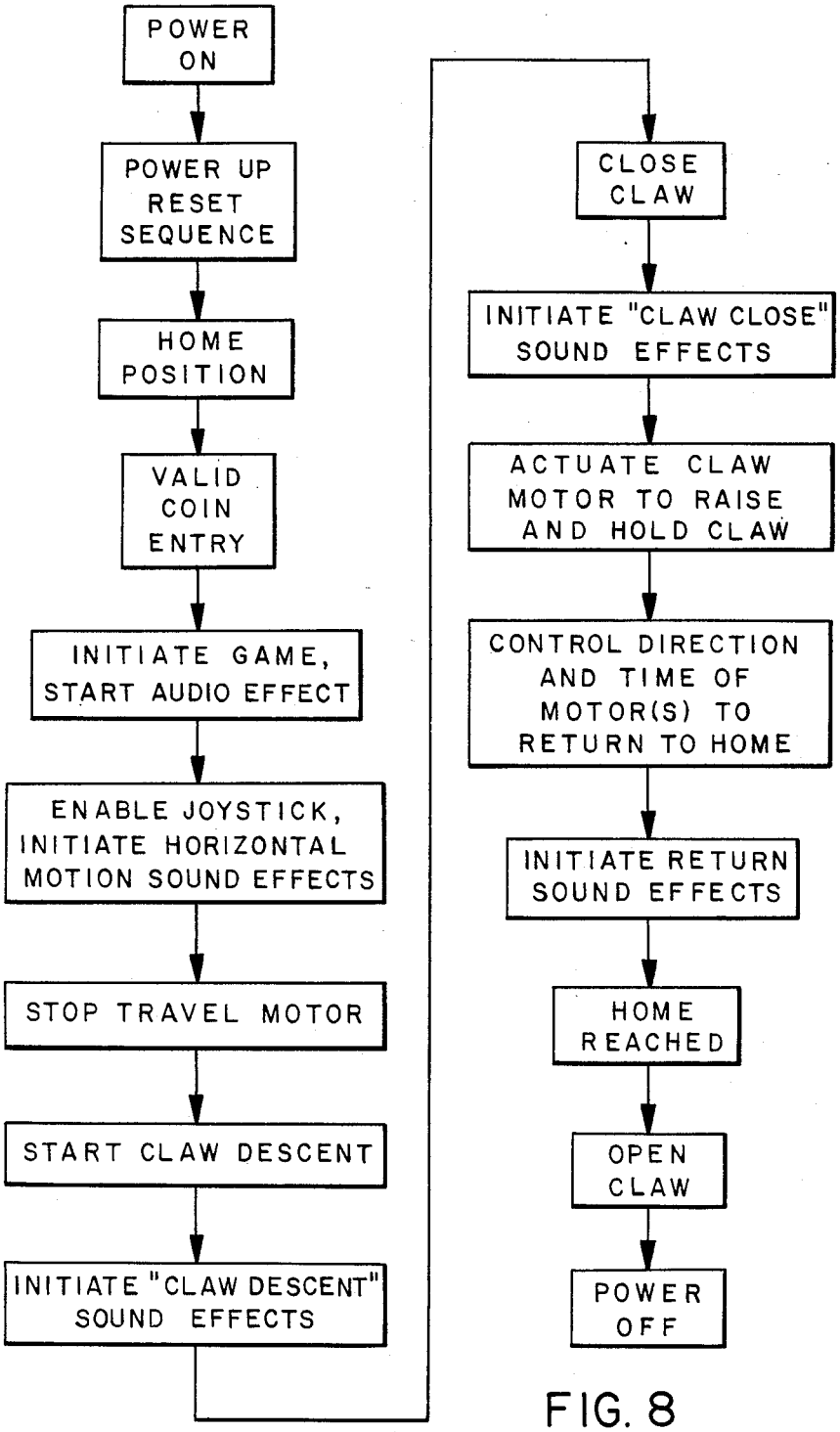
FIG. 8 is a flow diagram of the game sequence.

The interior of the housing is divided into an upper playing area or compartment 16 by a transverse wall or floor 18 on which a circular table or playing floor 20 is rotatably mounted. As best shown in FIGS. 1 and 2, table 20 has a central opening 22 through which hollow support post 24 projects. The table 20 is rotated about post 24 via spaced roller wheels 26 on which it rests. One of the wheels is driven by motor 28 and the other two comprise idler rollers. An electronic game control system, which is described in more detail below in connection with FIGS. 7 and 8, is suitably mounted in the lower compartment 29 of the housing below the floor 18. The upper compartment defines a play area visible to players attempting to win prizes which will be distributed over the circular table.

Suspended above the rotatable floor 18 are four spaced pick-up or grabber units 30. Each unit comprises a pick up or claw device 32 suspended from a carriage 34 which is slidably mounted on a horizontal guide rod or arm 36 defining a horizontal line of movement of the carriage and claw above the rotating table 18. The four guide rods 36 extend generally radially across the table 18, as seen in FIG. 1, and are each supported at their inner ends on vertical support posts 38 as shown in FIG. 2, which are located within hollow post 24 at the center of the table 20 and are rigidly mounted on base panel or floor 18.

Four spaced delivery chutes 40 for delivering prizes to a player are provided in the floor 18 at the four corners of the housing just outside the periphery of the table 18 and directly below the outer ends of each of the guide rods 36. Each chute leads into a delivery opening 42 in the outer wall of the housing 12, as shown in FIG. 2.

Horizontal and vertical transport mechanisms are provided for moving each claw or grabber 32 back and forth along the respective guide rod and up and down from the carriage 34 to the level of prizes on the playing table 20. The transport mechanisms are shown in more detail in FIGS. 3 to 6.

Figure 3:
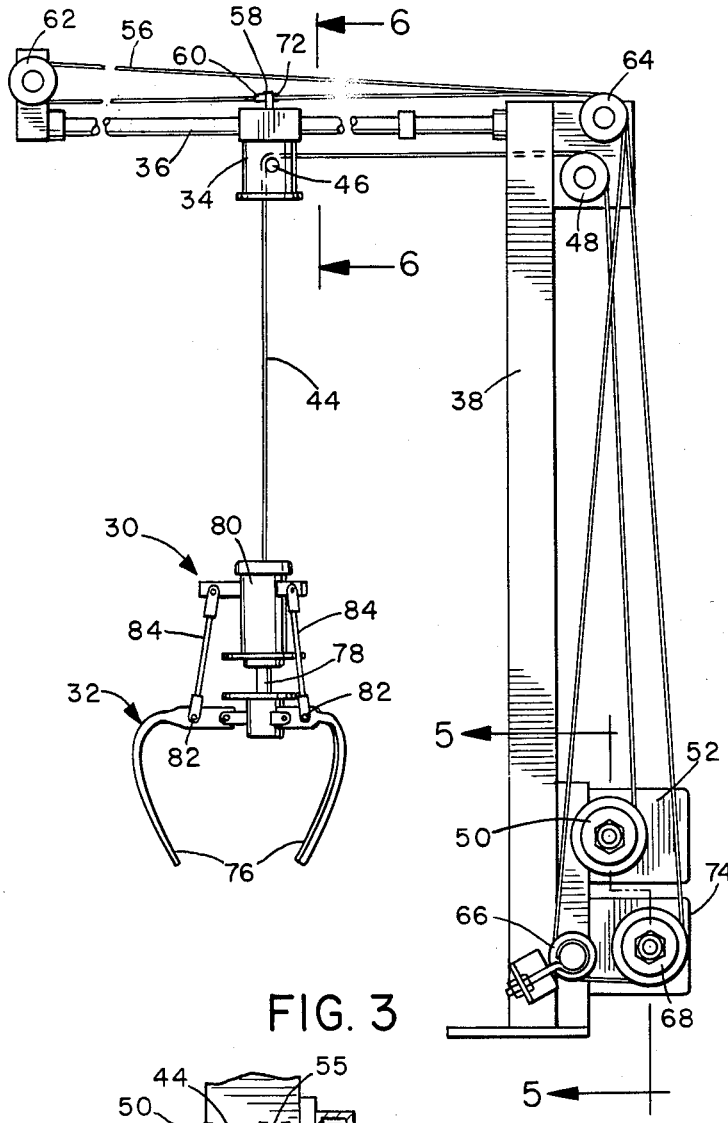
FIG. 3 is an enlarged side elevation view of one claw unit.
Figure 4:
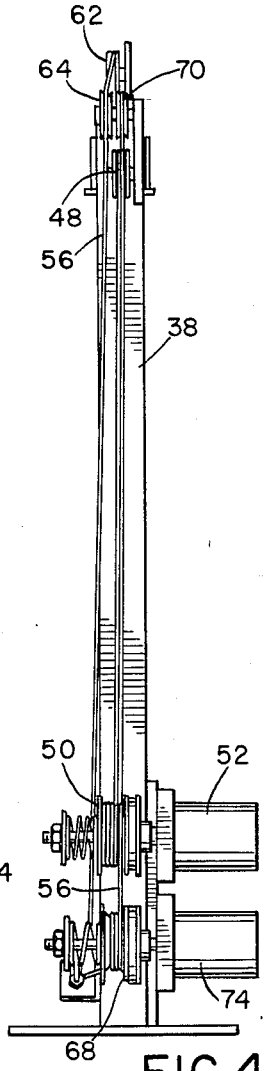
FIG. 4 is a rear elevation view of the claw unit.
Figure 5:
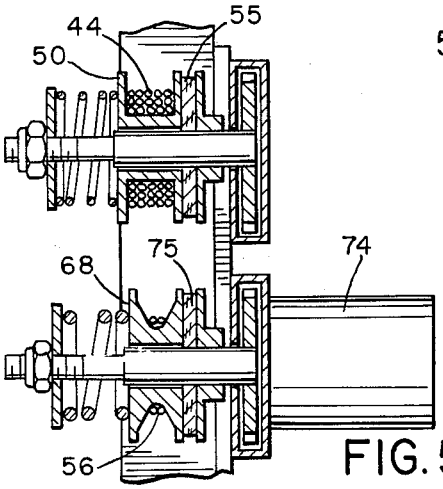
FIG. 5 is an enlarged sectional view taken on line 5—5 of FIG. 3.

As shown in FIG. 3, each claw is suspended via a chain or line 44 from its carriage 34. The line 44 extends over a bolt or guide 46 within carriage 34, over a guide roller 48 mounted at the upper end of post 38, and down over a driven roller 50 at the lower end of the post 38. The roller 50 is driven in opposite directions by claw drive motor 52 through a spring-loaded clutch 55 in a winch-like action to either wind the line onto the roller or to unwind it to allow the claw to drop.

Figure 6:
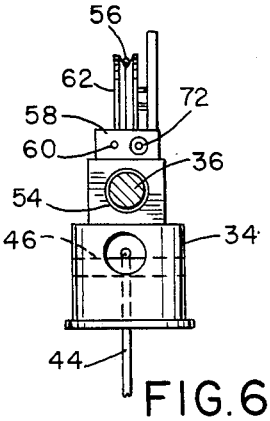
FIG. 6 is an enlarged sectional view taken on line 6—6 of FIG. 3.

Each carriage 34 has a through bore 54 for slidably engaging over the respective lateral or horizontal guide rod 36, as best shown in FIG. 6. The carriage is secured to an overhead pulley assembly for pulling it back and forth along the guide rod 36 between its extreme positions above the delivery chute and adjacent the center of table 20. The pulley assembly has a pulley line 56 secured at opposite ends to opposite faces of a plate 58 extending upwardly from carriage 34 above the guide rod 36. The line extends from one end 60 around a first pulley roller 62 mounted at the outer end of guide rod 36, then back around a second roller 64 mounted at the top of vertical post 38. From roller 64 the line extends around idler roller 66 mounted at the lower end of post 38, as shown in FIG. 3, and then around drive roller 68. The line is double wrapped around roller 68 for increased friction, and then extends back to the top of post 38, around a roller 70 positioned adjacent roller 64, and is then secured at its opposite end 72 to the opposite face of plate 58.

Rotation of drive roller 68 via travel motor 74 in opposite directions will act to pull the carriage back and forth along guide rod 36 between its extreme positions. Drive roller 68 is also driven via a spring-loaded clutch 75, and the clutch on the pulley motor 74 is preferably stronger than that on claw motor 52, for example by providing a stronger spring on the pulley motor clutch. Also, the effective diameter of the claw drive roller will be larger than that of the pulley drive roller, as will be explained in more detail below.

The mechanical claws or pick up devices 32 in this embodiment are of the same general type as described in my copending application Ser. No. 791,687, referred to above. Each pick-up device comprises three spaced, pivotally mounted fingers or prongs 76 which are moveable between the open position shown in FIG. 3 and a closed position in which they are moved together so that any object between the fingers can be gripped and picked up. The fingers are each pivotally mounted at their upper ends on a plunger 78 operated by means of solenoid 80. The fingers are also each pivotally connected at an intermediate point 82 in their length to a respective lever arm 84 pivotally mounted at its opposite end on the upper end of the solenoid housing. Thus, retraction of the plunger 78 on actuation of the solenoid will cause the prongs to pivot inwardly about points 82 into the closed position. Subsequent release of the plunger 78 will cause it to drop under the action of gravity into the fully extended position, causing the prongs to pivot in the opposite direction into the open position shown in FIG. 3. An electrical cable (not shown) extends from the solenoid to the control circuit in the lower part of the housing for switching the solenoid on and off. This may suitably extend down through the central opening in the rotating prize table.

Operation of the game apparatus described above will now be described in more detail, with reference to the control and flow diagrams of FIGS. 7 and 8 as well as to FIGS. 1 to 6. A player control unit or panel on the outer face of the housing will be associated with each claw unit. Although there are four claw units in FIG. 1, a greater or lesser number of units may be provided in alternative embodiments. Thus more than one player can play on the same machine simultaneously, reducing the cost of such machines and also the space taken up per player. The units are suitably equally spaced, with 4, 6 or 8 or more units per table, for example.

As shown in FIG. 7, the control panel includes a lever 90 for moving the carriage back and forth along its arm or guide rod 36, a claw down button 92 for controlling descent of the claw from the carriage, a claw stop button 94 for stopping the claw at a selected point in its descent, and a claw close button 96 for actuating the solenoid to close the claws.

FIG. 7 illustrates in block diagram the game control system for controlling operation of the claw movement and actuation. The control system also controls operation of an audio system 99 in the preferred embodiment of the invention, which is connected to a loudspeaker 100 in the game housing for generating suitable sound effects to accompany the game which reflects the moment-by-moment status of the game sequence. These sound effects are preferably of a similar nature to those described in my co-pending application Ser. No. 791,687.

The game control system is preferably constructed on a single printed circuit board contained within the housing and suitably connected to the drive motors, solenoid, and player control panel by electrical cables, as indicated by the connecting lines in FIG. 7. A coin operated switch 102 is actuated on detection of deposit of a valid coin or token to initiate a game, via a slot (not shown) provided adjacent each player control panel. A game timer and sequence controller 104 is suitably programmed to control play of a game according to a predetermined game sequence so that the playing procedure is consistent from game to game. Such a sequence controller was described in my co-pending application Ser. No. 791,687, and a similar type of controller is used in this apparatus, with suitable programming for performing the play sequence described below. The game sequence in the preferred embodiment of the invention is shown in the flow diagram of FIG. 8.

As shown in FIG. 8, the sequence controller initiates a "power up reset sequence" each time the power is turned on. This tests the system and ensures that the or each carriage and claw device is positioned at the home position, preferably above the respective delivery chute. This is the normal starting position for play.

The playing table or floor 20 will have suitable prize items (not shown in the drawings) distributed over it. As indicated in the flow diagram of FIG. 8, a player initiates a game sequence by depositing a coin or token in a suitable slot (not shown). At this point the player will have control over the movement of the associated claw unit via the control panel 82.

In the preferred embodiment of the invention the period of time in which the player has control of the claw unit is limited by the timing and sequence controller, and after the player has attempted to pick up a prize or the time period expires the claw will be automatically returned to the home position.

The timing and sequence controller controls the supply of power from power supply 98 to the horizontal drive or travel motor 74, the claw drive motor 52, the table drive motor 28 and the solenoid. The table drive motor is preferably switched on automatically for the entire game sequence. At the start of a game, the lever or joystick is enabled and power is supplied to travel motor 74. The player controls the direction of movement of the carriage by moving the lever back and forth to drive motor 74 either in forward or reverse, as indicated in FIG. 7. After the player controlled sequence of the game, the sequence controller operates motor 74 automatically to drive the carriage back to its home position.

While the claw carriage is moved back and forth along guide rod 36 by the player, using control lever 90, or during its automatic return movement to the home position, the claw is held at the top of its station against the carriage. This avoids potential swaying of the claw during horizontal movement, which makes positioning more difficult and could potentially cause the claw to drop a prize in its return movement.

As the claw moves from the innermost position towards the outer end of the guide rod, the sequence controller is arranged to turn the claw motor off. Since the chain will be pulled out from the winch roller by outward movement or the claw, the claw motor clutch will slip, holding the claw at the top against the carriage. When the horizontal movement motor is reversed to move the carriage back towards the inner end of the guide rod, the claw motor is energized to operate in a clockwise direction, drawing in the chain onto the roller 50 to hold the claw against the carriage. Because the claw drive roller is of larger diameter than the horizontal movement drive roller, the chain will be pulled in at a slightly faster rate than the carriage movement, so that the claw is positively held against the carriage at the top of its vertical movement.

When the player decides that the claw is in the right horizontal position to coincide with a selected prize on the table, which rotates continuously during the game sequence, the claw drop button is pressed. At this point the horizontal travel motor is switched off and the claw motor operates counterclockwise to unwind the chain and lower the claw. If the player has misjudged the timing for the claw to meet the selected prize, the claw stop button can be pressed to turn off claw motor 52 and hold the descent of the claw momentarily, and then released to allow the claw to descend again. As soon as the player feels that the claw is positioned over the prize, the claw close button can be pressed, actuating the claw solenoid to close the claw fingers, hopefully grasping the prize between the fingers.

From this point the operation is automatic and controlled, by suitable timing of the sequence controller. The claw motor is reversed on pressing the claw close button and the claw will be raised to its top position against the carriage. When the claw is at the top the pulley motor is energized by the timing and sequence controller, and the claw is returned to the home position above the delivery chute. When the claw is home the power to all the motors and the solenoid is turned off, again under the control of timing and sequence controller, and the claw opens, releasing any prize which was picked up for delivery to the player via the delivery chute.

The sequence controller may be arranged to allow the player to have control over the horizontal movement for a predetermined time period only, after which the claw will drop automatically if the claw drop button has not been pressed. Suitable sound effects may be used to indicate to the player that the time remaining is limited. Similarly, the period of time allowed for claw descent, stopping and closing may be limited under the control of a suitable timer in the sequence controller.

In the preferred embodiment of the invention the travel and claw motors are driven by two similar control circuits 106, 108 for reversing the direction of the associated motor and for switching the power on and off. These circuits are controlled by suitable control lines either from the player control panel or from the timing and sequence controller, according to the predetermined game sequence. The controller suitably comprises a programmable memory chip with outputs connected to the various motor and solenoid controls.

The game apparatus of this invention is greatly simplified over previous crane type games requiring four directions of horizontal movement to pan over an entire playing floor. In the present invention only two horizontal directions of movement back and forth along the same linear path are required to cover the whole playing floor, which will rotate continuously under the linear path. Thus the horizontal drive mechanism is greatly simplified and is much lighter and more compact.

The arrangement allows more than one claw unit to be provided in the same game housing, reducing the space taken up per player considerably and also reducing the costs to purchasers of such games. By providing all the drive motors within the central column, where they will be hidden from the players view and out of the way of all moving parts of the unit, the visible part of the housing interior can be made more attractive and the carriage itself can be of a more lightweight construction, since the claw motor does not need to be mounted on the carriage itself.

The player will be able to exercise skill in attempting to position the claw to pick up a prize, by suitably positioning the claw on the lateral rod before actuating the claw lowering motor, and by suitably stopping the claw to coincide with the position of a prize on the rotating table before actuating the claw to close the claw fingers. The movement back and forth above the rotating table is much easier for the player to control than the four directional movement in other games of this type, and thus the success level can be increased. Since the player has control over the horizontal and vertical movement of the claw, and the claw closure, skill will be involved in attempting to win a prize.

Since the motors are mounted on the support floor and not on the carriage, and the transport mechanisms are both pulley assemblies, the movement of the carriage and claw will be relatively smooth and vibration free. The motors are automatically turned off at the end of each game after the expiry of a sufficient time period to return the carriage and claw to the home position.

Although a preferred embodiment of the invention has been described above by way of example only, it will be understood by those skilled in the field that modifications may be made to the disclosed embodiment without departing from the scope of the invention, which is defined by the appended claims.

I claim:

1. An amusement apparatus, comprising:

a housing;

a floor over which prize items can be distributed, the floor being rotatably mounted in the housing;

drive means for rotating the floor;

delivery means for delivering items to a player;

pick up means for picking up items from the floor of the housing;

a transport mechanism for transporting the pick-up device, comprising horizontal transport means for transporting the pick up means back and forth on a line of travel above the floor between two extreme positions, and vertical transport means for moving the pick up means vertically up and down between a raised position and a lowered position at the level of underlying prize items; and control means for controlling operation of the transport mechanism and the pick up means, the control means including an external, player control assembly including means for at least partially controlling the horizontal and vertical transport means, means for enabling the player control assembly for controlling travel of the pick up means back and forth along said line of travel, means for enabling the player control assembly for lowering the pick up means towards the prize table at a selected horizontal position, means for automatically stopping horizontal movement on lowering of the pick up means towards the table, means for enabling a player to actuate the pick up means to attempt to pick up a prize at a selected lowered position, and means for automatically returning the pick up means to a home position after actuation of the pick up means.

2. The apparatus as claimed in claim 1, wherein the floor is circular and a plurality of pick up units are spaced evenly around the floor, each unit comprising pick up means and an associated transport mechanism for transporting the pick up means back and forth along a generally radial path above the playing floor and vertically up and down between a raised position and a lowered position at the level of prizes on the floor.

3. The apparatus as claimed in claim 2, wherein the delivery means comprises a plurality of delivery chutes, each chute associated with a respective one of the pick up units and being positioned below the pick up means of that unit at the outer end of its path.

4. The apparatus as claimed in claim 2, wherein the rotatable table has a central opening, and a rigid hollow support column extends through the central opening, the table being rotatable about the support column.

5. The apparatus as claimed in claim 4, wherein the horizontal and vertical transport means each comprises a motor and pulley means linking the motor to the pick up means, the motors being mounted within the support column at the innermost end of the line of travel of each pick up means.

6. The apparatus as claimed in claim 1, wherein the horizontal transport mechanism comprises a rod, means supporting the rod horizontally above the rotatable floor to define the line of horizontal travel of the pick up means, a carriage slidably mounted on the rod, the pick up means being suspended from the carriage, and carriage drive means for driving the carriage back and forth along the rod.

7. The apparatus as claimed in claim 6, wherein the carriage drive means comprises a motor mounted at one end of the path of travel of the carriage along the rod, and pulley means driven by the motor and linked to the carriage, the pulley means extending along the length of the rod to define the opposite ends of travel of the carriage.

8. The apparatus as claimed in claim 1, wherein the pick up means comprises a carriage, and a claw device suspended from the carriage, and the vertical transport mechanism comprises a claw drive motor mounted at one end of the path of travel, a winch roller driven by the drive motor, and a connecting line extending from the winch roller and through the carriage to the claw device, the claw drive motor comprising means for selectively winding and unwinding the connecting line onto the winch roller to raise and lower the claw device, respectively.

9. The apparatus as claimed in claim 8, wherein the horizontal transport mechanism includes a travel motor mounted at the same end of the path of travel as the claw drive motor, and pulley means linking the travel motor to the carriage for driving it back and forth along the path of travel, the pulley means including a drive roller directly linked to the motor and idler rollers at opposite ends of the path of travel.

10. The apparatus as claimed in claim 9, wherein the winch roller has a larger effective diameter than the drive roller.

11. The apparatus as claimed in claim 1, wherein the player controlled means comprises means for controlling the horizontal transport mechanism to drive the pick up means to a selected position along its line of travel, means for lowering the pick up means, means for stopping the pick up means at a selected vertical position, and means for actuating the pick up means to attempt to pick up a prize.

12. The apparatus as claimed in claim 1, wherein the control means includes means for continuously rotating the playing floor during each playing sequence.

13. The apparatus as claimed in claim 1, wherein the horizontal drive means comprises a horizontal drive motor mounted in the housing and pulley means linking the horizontal drive motor to the pick-up means, and the vertical drive means comprises a vertical drive motor and pulley means linking the vertical drive motor to the pick-up means.

14. The apparatus as claimed in claim 1, including a transverse wall in the housing, the floor comprising a circular table rotatably mounted on the transverse wall for carrying prize items in a circular path, and a series of identical pick up units spaced around the prize table, each pick up unit including an overhead carriage, means for supporting the overhead carriage above the prize table to travel in a linear, radial path between an inner position adjacent the center of the table and an outer position just outside the outer periphery of the table, and a pick up device suspended from the carriage;

the delivery means comprising a delivery chute below the outer position of each pick up unit for delivery of prizes to a player; and the control means including a player control panel associated with each pick up unit and means for selectively enabling the player control panel according to a predetermined game sequence to allow the player at least partial control of the horizontal and vertical transport means.

15. An amusement device control system for controlling operation of a prize retrieval game in which a pick up device is operated by a player in an attempt to retrieve prizes within an enclosed play area, the system including:

means for initiating a predetermined game sequence on player deposit of a predetermined token;

means for continuously rotating a prize table on which prizes are distributed below a pick up device;

means for enabling a player control means for controlling travel of the pick up device back and forth along a linear path above the rotating prize table;

means for enabling a player control means for lowering the pick up device towards the prize table at a selected point on the path of travel;

means for automatically stopping horizontal movement of the pick up device on lowering of the pick up device towards the prize table;

means for enabling a player to actuate the pick up device to attempt to pick up a prize at a selected lowered position;

means for automatically returning the pick up device to a home position after automatic or player initiated actuation of the pick up device; and means for delivering any picked up prize to the player.

16. The system as claimed in claim 15, including:

means for automatically switching off a pick up device lowering motor during horizontal movement of the pick up device in an outward direction relative to the playing floor; and means for automatically switching on the pick up device motor in a direction to hold the pick up device in its uppermost position during horizontal movement of the pick up device in the opposite, inward direction towards the center of the playing floor.

17. An amusement apparatus, comprising:

a housing;

a circular floor over which prize items can be distributed, the floor having a central opening;

a rigid hollow support column extending through the central opening of the floor, the floor being rotatable about the support column;

drive means for rotating the floor;

delivery means for delivering items to a player;

a plurality of pick up units spaced evenly around the floor, each unit comprising pick up means for picking up items from the floor of the housing and an associated transport mechanism including horizontal transport means for transporting the pick up means back and forth along a generally radial path above the playing floor and vertical transport means for transporting the pick up means vertically up and down between a raised position and a lowered position at the level of prizes on the floor;

the horizontal and vertical transport means each comprising a motor and pulley means linking the motor to the pulley means, the motors being mounted within the support column at the innermost end of the line of travel of each pick up means; and control means for controlling operation of the transport mechanism and the pick up means, the control means including an external, player control assembly including means for at least partially controlling the horizontal and vertical transport means, and means for automatically switching off the vertical drive motor as the pick up means moves horizontally between the innermost and outermost end of its radial path, and for automatically switching on the vertical drive motor to drive in reverse as the pick up means moves horizontally from the outermost to the innermost end of its radial path.

* * * * *